US007004321B1

(12) United States Patent
Palm et al.

(10) Patent No.: US 7,004,321 B1
(45) Date of Patent: Feb. 28, 2006

(54) CUMULATIVE PACKAGING PROVIDED FOR THE REMOVAL OF FILLED POUCHES IN A PREDETERMINED ORDER

(75) Inventors: Detlef Palm, Ochtendung (DE); Ronald Hackbarth, Bad Ems (DE); Michael Heberle, Hillscheid (DE); Detlev Neuland, Nickenich (DE)

(73) Assignee: LTS Lohmann Therapie-Systeme AG, Andernach (DE)

( * ) Notice: Subject to any disclaimer, the term of this patent is extended or adjusted under 35 U.S.C. 154(b) by 0 days.

(21) Appl. No.: 09/936,545

(22) PCT Filed: Mar. 9, 2000

(86) PCT No.: PCT/EP00/02043

§ 371 (c)(1),
(2), (4) Date: Sep. 14, 2001

(87) PCT Pub. No.: WO00/55061

PCT Pub. Date: Sep. 21, 2000

(30) Foreign Application Priority Data

Mar. 17, 1999 (DE) ..... 199 11 799

(51) Int. Cl.

| | |
|---|---|
| ***B65D 73/00*** | (2006.01) |
| ***B65D 75/00*** | (2006.01) |
| ***B65D 77/00*** | (2006.01) |
| ***A61K 9/00*** | (2006.01) |
| ***A61K 9/70*** | (2006.01) |

(52) U.S. Cl. ..... 206/472; 206/438; 206/460; 206/461; 206/464; 206/466; 206/474; 424/400; 424/443; 424/447; 424/448; 424/449

(58) Field of Classification Search ..... 206/438, 206/460, 461, 464, 466, 472, 474; 424/400, 424/443, 447, 448, 449

See application file for complete search history.

(56) References Cited

U.S. PATENT DOCUMENTS

| | | | | |
|---|---|---|---|---|
| 2,715,493 A | | 8/1955 | Vogt | |
| 3,915,302 A | | 10/1975 | Farrelly et al. | |
| 4,502,599 A | | 3/1985 | Perecman | |
| 5,422,119 A | * | 6/1995 | Casper | 424/449 |
| 5,686,112 A | | 11/1997 | Liedtke | |

FOREIGN PATENT DOCUMENTS

| | | | |
|---|---|---|---|
| CH | 339119 | | 5/1959 |
| DE | 1683678 | | 8/1954 |
| DE | 16 83 678 | U1 | 8/1954 |
| DE | 1027844 | | 4/1958 |
| DE | 10 27 844 | | 9/1958 |
| DE | 18 23 247 | U1 | 12/1960 |
| DE | 1823247 | | 12/1960 |
| DE | 2180313 | | 11/1978 |
| DE | 88 11 648 | U1 | 11/1988 |
| DE | 88 11 6484.4 | | 12/1988 |
| DE | 2629797 | | 10/1989 |
| DE | 42 23 004 | A1 | 1/1994 |
| DE | 44 40 727 | A1 | 5/1996 |
| DE | 44 40 727 | | 5/1996 |
| EP | 447 712 | | 5/1936 |
| EP | 15 74 347 | | 9/1980 |
| EP | 0 409 383 | A2 | 1/1991 |
| FR | 2629797 | A * | 10/1989 |
| GB | 447712 | | 5/1936 |

* cited by examiner

*Primary Examiner*—Thurman K. Page
*Assistant Examiner*—Simon J. Oh
(74) *Attorney, Agent, or Firm*—Frommer Lawrence & Haug LLP

(57) ABSTRACT

The invention relates to a packaging of products which are additionally packed in a pouch (2) in order to protect the same, whereby the packaging is comprised of at least two pouches. The products placed in these pouches can be identical or different. These products are to be preferably removed and used in a predetermined order.

11 Claims, 4 Drawing Sheets

Multipack with simple backing

Figure 1: Multipack with simple backing
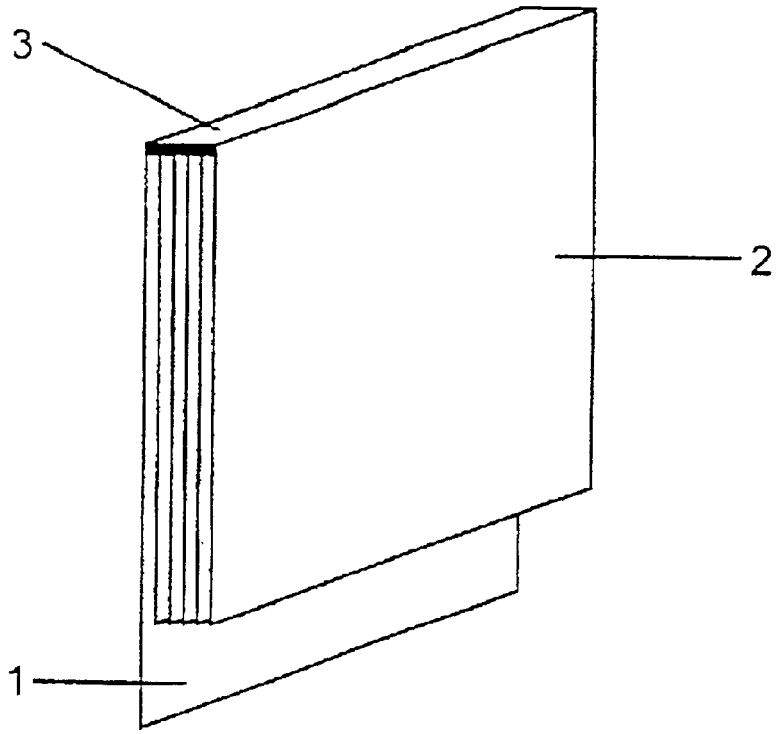
Figure 2: Multipack with cover
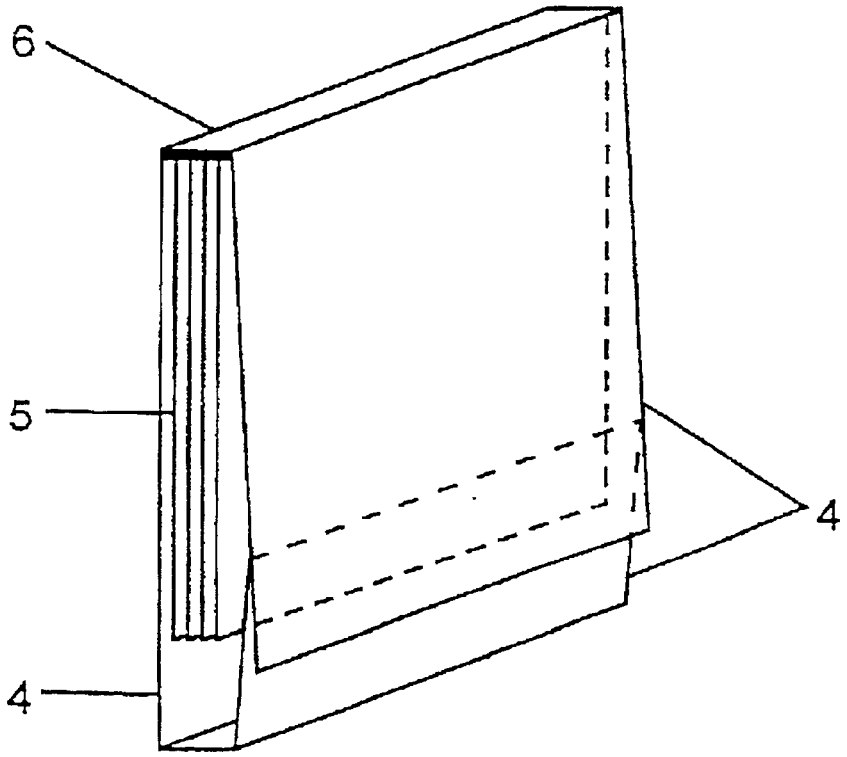

Figure 3: Multipack with cover opened
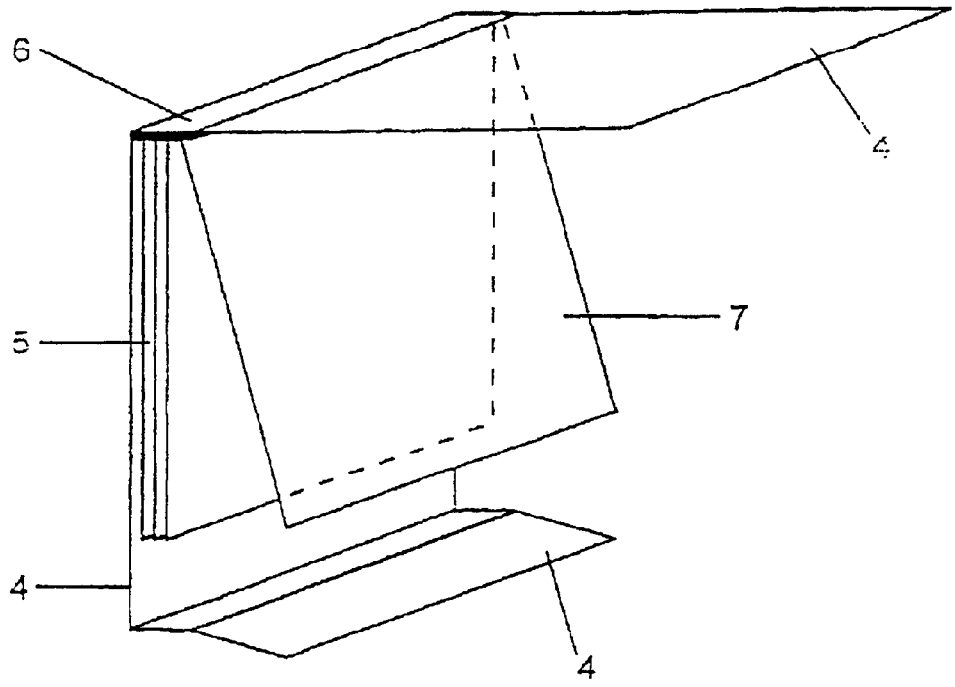
Figure 4: Multipack with backing and perforated edge
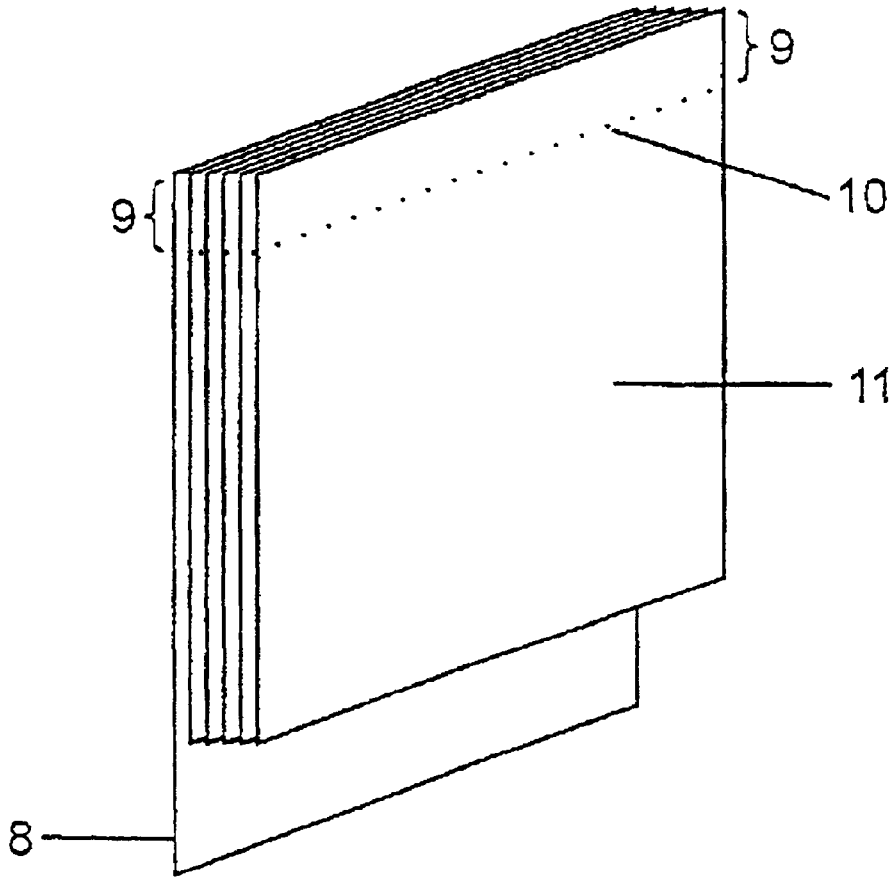

Figure 5: Multipack with backing and perforated edge, after two bags have been removed
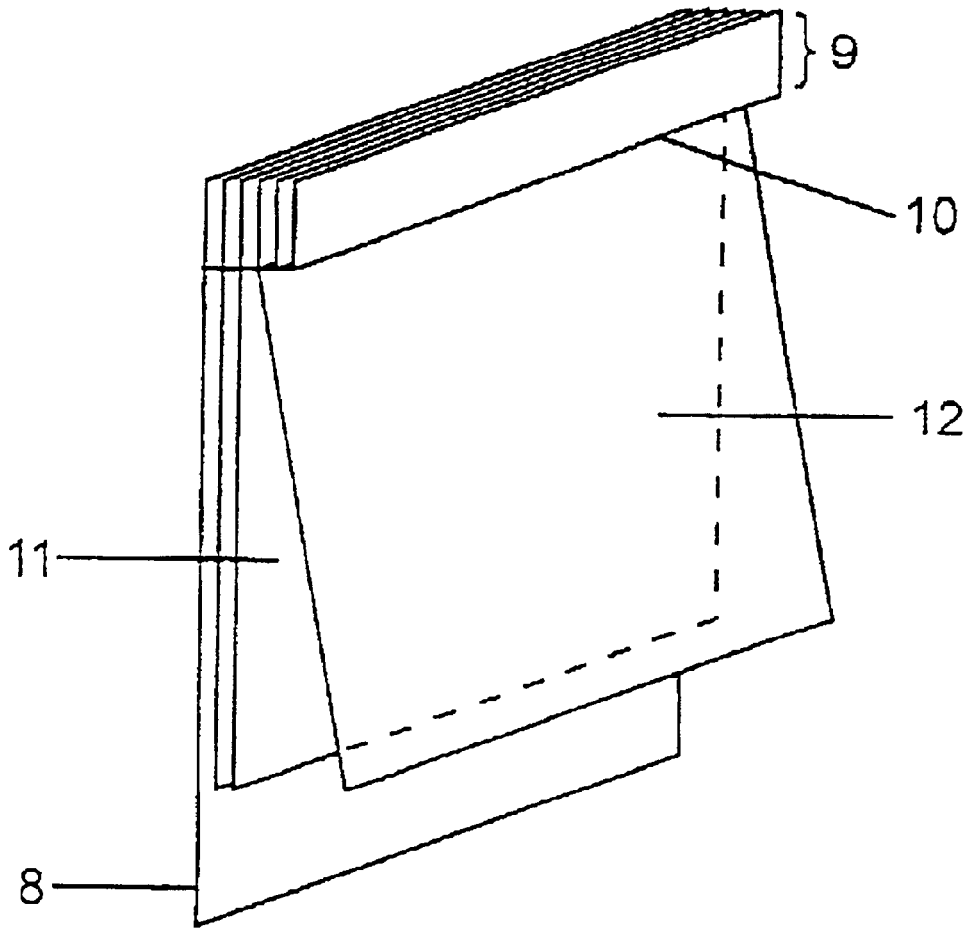

Figure 6: Multipack with spacers (13) between the superposed sections of the edges (9) of adjacent bags (5)
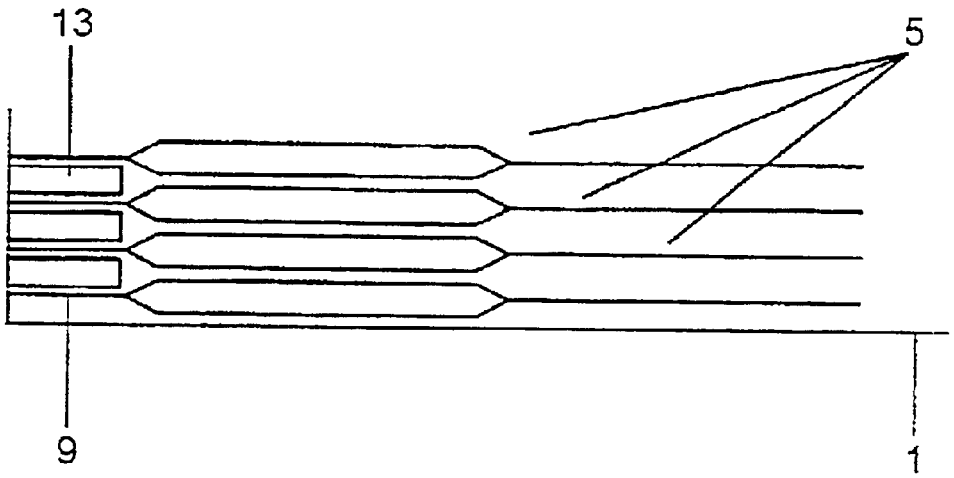
Figure 7: Multipack with margins of the edges (9) offset in parallel
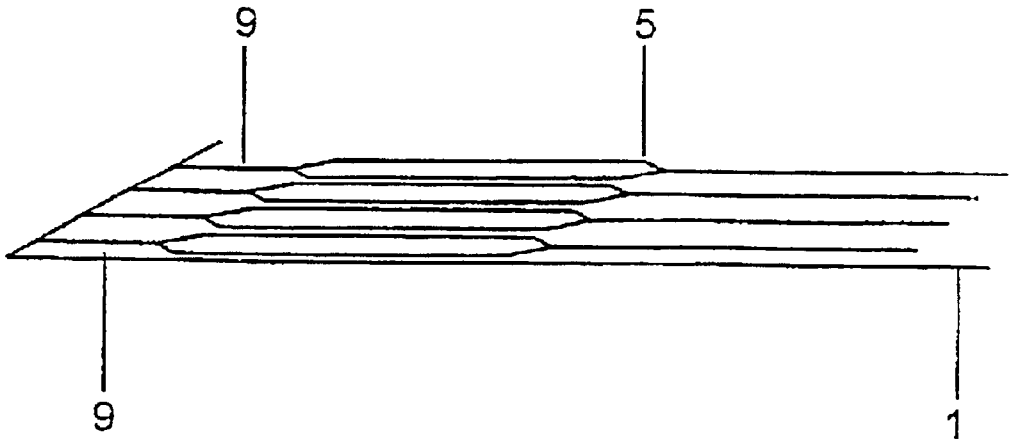

CUMULATIVE PACKAGING PROVIDED FOR THE REMOVAL OF FILLED POUCHES IN A PREDETERMINED ORDER

The invention relates to a pack of products which are packed for protection in a bag, the pack consisting of at least two bags. The contents (products) present in these bags can be identical or different. These contents are preferably to be removed and used in a predetermined sequence. These bags are of the type which have an inner area and an edge enclosing this inner area, for example rectangular sealed bags known to the person skilled in the art. Of course, these bags can also be sealed on only two or three edges or on one edge.

The products concerned are preferably planar systems, for example stickers, labels, tissue wipes, diskettes, CD-ROMs, chip cards, coins, postage stamps, planar systems for oral or transdermal application or plasters and the like. In a particular embodiment, the products concerned are identical and/or different hormone plasters (transdermal therapy systems with sex hormones). These plasters can be used, for example, in the context of hormone replacement therapy, where, in a first phase (duration about 14 days), a plaster containing an estrogen is applied every third day and, in a second phase (duration about 14 days), a plaster containing an estrogen and a gestagen is applied every third day. In such therapy, therefore, about 4 plasters have to be used in the first phase, and then about 4 plasters in the second phase.

Thus, the object of the invention is to simplify the administration of these plasters in the intended therapy schedule, and to avoid confusion occurring, by providing a multipack which contains a defined number of planar systems, for example a total of 8 plasters in the respective bags, in the required sequence and joined together in a block.

The object is achieved by a multipack for removing individual bags, wherein the bags have an inner area and an edge enclosing this inner area, wherein at least two bags are joined together to form a block, wherein within this block a section of the edge of a first bag lies almost over the whole surface of the section of the edge of an adjacent second bag, and, wherein within this block, the thereby superposed sections of the edges of the respectively adjacent bags are firmly connected to one another.

This block can additionally be provided with a backing. To protect the bag from contamination and mechanical damage, the backing can be replaced by a re-sealable cover which encases the bags. The cover can additionally be closed with a closure seal so that the person buying the pack can tell whether the pack is still intact. Such a seal is, for example, a sticker which is stuck on two articulated flaps. The materials from which the backing or the cover are made can be paper, paperboard, cardboard, plastic, metal, plastic foil, composite materials such as metal-coated and/or plastic-coated paper, etc.

However, the block itself can also be provided with a closure seal. In this case, such a seal (sticker) is arranged to the side of or opposite the connecting means which firmly connect the superposed sections of the edges of the respectively adjacent bags.

This multipack (so-called calendar pack, ie. the block of several firmly connected bags) can then be packed in a conventional folding carton. In the case of large packs, a plurality of these multipacks can be combined in one folding carton.

If the contents present in the inner area of the bags have a certain thickness, and if the block contains a plurality of bags, these bags can fan out, but this can be avoided by using spacers. For this purpose, a spacer (see FIG. 6) is inserted in this block between the section of the edge of a first bag and the almost fully overlying section of the edge of an adjacent second bag and then, in this block, the thereby superposed sections of the edges of the respectively adjacent bags and the intermediate spacers (eg. foil made of plastic, paper strips) are firmly connected to one another. The spacers preferably have a thickness which corresponds to the thickness of the contents of a bag. Adapting the thickness of the adhesive layer or adhesive foil is not necessary.

The user (eg. the patient) first removes the multipack from the folding carton. By means of the original seal (ie. the undamaged closure seal), it is possible to tell whether the multipack has already been opened. After opening the seal, the user first removes the uppermost bag since this is the one presented to the user and the easiest to remove. The backing or the cover ensures that the user cannot remove a bag from the back and thus in the incorrect order, i.e. reverse order. On removing the first bag, the joins between the remaining bags are not destroyed and the required sequence is thus retained. The remaining bags are then protected by closing the cover.

The intended sequence of removal of the bags and the sequence of application of the contents (plasters, TTS) are further indicated by providing printed information (eg. numbers, date) on the individual bags.

In a particular embodiment, the section of the edge of a first bag is laid over the section of the edge of an adjacent second bag in such a way that the respective margins of these edges are slightly offset in parallel (see FIG. 7). The advantage of this is that that when an adhesive is used as connecting means, the contact surface between adhesive and bag foil is increased and a better hold on the bags is afforded. This also makes it easier to use an adhesive tape as connecting means. The extent of the parallel offset generally depends on the thickness of the bags and in a preferred embodiment this amounts to at least 0.3 mm.

Such multipacks are produced in the following steps:

a) manufacturing the product-filled bags in conventional manner, b) superposing these bags in such a way that the section of the edge of a first bag lies almost over the whole surface of the section of the edge of an adjacent second bag, the subsequent sequence of removal and application being observed, and c) permanently connecting the superposed sections of the edges of the bags.

If appropriate, perforation lines or other predetermined break lines are even punched into the edge of the bag during the manufacture of the product-filled bags.

If appropriate, a backing or cover is also laid under the superposed bags before or after the permanent connection of the superposed sections of the edges.

In a particular embodiment of this production method, after the bags to be permanently connected have been placed over one another, these bags are offset in parallel slightly (preferably by at least about 0.3 mm in each case) so that upon subsequent connection of the superposed sections of the edges of the bags with the aid of adhesives, for example, the contact surface between adhesive and bag is increased.

In another embodiment, the bags of a multipack can hold two different types of contents (eg. two TTS with different active substances or active substance combinations) which have to be removed in a predetermined sequence corresponding to the sequence of the bags within the multipack (from the top toward the backing).

According to the invention, the multipack can be used in a method for transdermal administration of hormones in which, in a first treatment phase, at least one transdermal therapy system (TTS) is administered which contains at least one estrogen, and, in a second treatment phase, at least one transdermal therapy system is administered which contains at least one estrogen and one gestagen. For this purpose, at the start of the first treatment phase, at least one bag containing a transdermal therapy system with at least one estrogen is removed from the multipack and applied to a user's skin and, at the start of the second treatment phase, at least one bag containing a transdermal therapy system with at least one estrogen and one gestagen is removed from said multipack and applied to user's skin.

The actual number of bags in the multipack in this case depends on what period of administration the individual transdermal therapy systems are designed for. If the transdermal therapy systems are plasters, for example, which are intended to be worn by the user for three days, a total number of two times four TTS or two times five TTS is recommended, the number two here relating to the different TTS types (estrogen-containing or estrogen-and gestagen-containing).

Embodiments of the multipack according to the invention are explained with reference to FIGS. 1 through 7:

FIG. 1 shows a basic form of the multipack according to the invention. It comprises a simple backing (1) and the individual bags (2) which are connected to one another at their ends to form a block with the aid of a connecting means (3). Such a connecting means can be, for example, a chemically or physically setting binder, that is to say adhesive, glue, one-sided or double-sided adhesive tape or the combination of such means. Hot-melt adhesives known to the person skilled in the art are preferably used.

FIG. 2 shows a further embodiment of the multipack. Here, the backing is in the form of a cover (4). The cover (4) encloses the individual bags (5). These bags, together with the cover, are connected to one another with the aid of the connecting means (6) to form a block.

In FIG. 3, the multipack is illustrated with a cover (4) in the opened state. The uppermost bag (7) can be removed from the front, without in so doing destroying the block of other bags (5).

FIGS. 4 and 5 illustrate a further embodiment of the multipack. Here, the bags (11, 12) have an additional edge (9) separated by a perforation line (10). The bags (11, 12) are connected to the backing (8) in the area of this edge (9) to form a block. This can be done in a known manner, inter alia by adhesive bonding, gluing, sealing or stapling. To remove the respective upper bag (12), the latter is separated at the perforation line (10). The perforation edge (9) of the removed bag remains firmly connected to the respective edges of the other bags (11 in FIG. 5) of the block.

FIG. 6 shows an embodiment in which spacers (13) lie between the almost fully superposed sections of the edges (9) of adjacent bags (5).

FIG. 7 shows an embodiment in which the respective margins of the edges (9) of the individual adjacent bags (5) are offset in parallel in the direction of the opposite edges.

What is claimed is:

1. A multipack which administers at least two different products wherein said products are planar systems for oral or transdermal application, said multipack comprising at least two individual bags that are joined together to form a block, wherein each individual bag comprises an inner area, which contains a product, each individual bag possesses an edge that encloses the inner area, the individual bags are arranged in a predetermined sequence, and whereas within said block an edge section of a first bag lies almost over the edge section of a second adjacent bag, thereby superimposing the edge sections of the two adjacent bags, the superimposed edge sections of the two adjacent bags are offset with respect to each other, and the superimposed edge sections of the respectively adjacent bags are connected to one another, wherein the sequence of said bags in said block corresponds to the predetermined sequence of removal.

2. The multipack as claimed in claim 1, which further comprise a backing or a resealable cover.

3. The multipack as claimed in claim 1, wherein said block further comprises a closure seal.

4. The multipack as claimed in claim 1, wherein the edge sections of respectively adjacent bags that are superimposed are connected to each other by a hot-melt adhesive, an adhesive tape, glue, staples, a sealing medium or a double-sided adhesive tape.

5. The multipack as claimed in claim 1, wherein the edge section of the bags comprises a perforation line.

6. The multipack as claimed in claim 1, wherein the superimposed edge sections of the two adjacent bags are parallel with respect to each other.

7. The multipack as claimed in claim 1, which further comprise spacers, which are placed between the superposed edge sections of the adjacent bags.

8. The multipack as claimed in claim 1, wherein the products are transdermal therapeutic systems containing an estrogen used in the first phase of hormone replacement therapy and transdermal therapeutic systems containing an estrogen and a gestagen used in a second phase of said hormone replacement therapy.

9. A method for producing a multipack which comprises at least two individual bags, wherein said bags comprise an inner area, which contains identical or different products, and an edge, wherein said edge encloses the inner area, and the identical or different products can be removed in a predetermined sequence, said method comprises:

superposing the edge section of a first product-filled bag on substantially the edge section of an adjacent second product-filled bag, in an order complying with the predetermined sequence of removal, arranging the superimposed edge sections of the product filled bags so that they are offset with respect to each other, permanently connecting the superposed edge sections of the product-filled bags.

10. The method as claimed in claim 9, wherein a perforated line is punched into the edge section of the bags which are to be superimposed.

11. The method for producing a multipack as claimed in claim 9, which further comprises inserting spacers between the edge sections of the bags which are to be superposed.

* * * * *